US007175498B2

(12) United States Patent
Garpow et al.

(10) Patent No.: US 7,175,498 B2
(45) **Date of Patent: *Feb. 13, 2007**

(54) COMBINATION TOY BUILDING BLOCK AND CONTAINER FOR HOLDING LIQUIDS AND THE LIKE

(76) Inventors: Scott Garpow, 144 Sandy Beach Rd. NE., Milledgeville, GA (US) 31061; Thomas Harris, 7914 Allegri Ct., Pasadena, MD (US) 21122

( * ) Notice: Subject to any disclaimer, the term of this patent is extended or adjusted under 35 U.S.C. 154(b) by 14 days.

This patent is subject to a terminal disclaimer.

(21) Appl. No.: 10/703,734

(22) Filed: Nov. 7, 2003

(65) Prior Publication Data

US 2004/0116037 A1 Jun. 17, 2004

Related U.S. Application Data

(63) Continuation-in-part of application No. 10/341,157, filed on Jan. 13, 2003, now abandoned, which is a continuation of application No. 10/021,816, filed on Nov. 29, 2001, now Pat. No. 6,506,091.

(51) Int. Cl.
*A63H 33/04* (2006.01)

(52) U.S. Cl. ..... 446/117; 446/121; 446/122; 446/124; 446/71

(58) Field of Classification Search ..... 446/117, 446/119, 120, 121, 122, 128, 124, 125, 73, 446/76, 71; 206/217, 457; 220/23.4, 23.6, 220/23.8, 4.27, 4.26; 215/10
See application file for complete search history.

(56) References Cited

U.S. PATENT DOCUMENTS 2,950,844 A * 8/1960 Hollingshead ..... 222/143
3,167,458 A * 1/1965 Brazell ..... 429/10
3,194,426 A * 7/1965 Brown, Jr. ..... 220/23.4
3,369,658 A * 2/1968 Hasselmann ..... 206/430
3,374,917 A * 3/1968 Troy ..... 220/23.4
3,474,843 A * 10/1969 Maris ..... 206/599
3,583,590 A * 6/1971 Ferraro ..... 215/10
3,658,204 A * 4/1972 Bottger ..... 220/23.4
3,862,683 A * 1/1975 Koelichen ..... 206/207
3,889,834 A 6/1975 Harris, Jr.
3,933,268 A * 1/1976 Buske ..... 220/23.4
3,994,408 A * 11/1976 Belitzky ..... 215/10
D249,230 S 9/1978 Van Der Veken
4,143,795 A * 3/1979 Casebier ..... 222/143
D252,910 S 9/1979 Bayly
4,287,997 A * 9/1981 Rolfe et al. ..... 220/1.5
D261,362 S 10/1981 Epperson
4,351,454 A * 9/1982 Maynard, Jr. ..... 222/143
4,570,799 A 2/1986 Mednis
4,656,840 A * 4/1987 Loofbourrow et al. ..... 62/530
4,919,296 A * 4/1990 Kirsh et al. ..... 220/737
4,925,066 A * 5/1990 Rosenbaum ..... 222/129

(Continued)

*Primary Examiner*—Bena Miller
(74) *Attorney, Agent, or Firm*—Myers & Kaplan, LLC; Ashish D. Patel, Esq.; Joel D. Myers, Esq.

(57) ABSTRACT

A combination toy building block and container for holding liquids and the like, wherein the functional configuration of the device permits both the carrying of a dispensable substance and the stacking of multiple containers, thereby enabling the imaginative play construction of buildings and objects such as, but not limited to, play forts, play houses, play cars and boats, statues, tables and chairs.

20 Claims, 14 Drawing Sheets

U.S. PATENT DOCUMENTS 5,007,551 A 4/1991 Baroi
5,067,922 A 11/1991 McMahon
D325,519 S 4/1992 Proctor
D333,978 S 3/1993 Zutler
D349,046 S 7/1994 Brown
D371,281 S 7/1996 Credle, Jr.
D377,887 S 2/1997 Credle, Jr.
5,676,251 A * 10/1997 Credle, Jr. ..... 206/501
5,782,358 A * 7/1998 Walker ..... 206/509
D412,646 S 8/1999 Credle, Jr.
D412,662 S 8/1999 Giskeodegaard et al.
6,029,858 A * 2/2000 Srokose et al. ..... 222/143
6,276,549 B1 * 8/2001 Fasci et al. ..... 220/23.4
6,506,091 B1 1/2003 Garpow
6,702,642 B1 * 3/2004 Parein ..... 446/105

* cited by examiner

COMBINATION TOY BUILDING BLOCK AND CONTAINER FOR HOLDING LIQUIDS AND THE LIKE

CROSS-REFERENCE AND PRIORITY CLAIM TO RELATED APPLICATIONS

To the full extent permitted by law, the present application claims priority to and the benefit of the following applications: as a continuation-in-part application of nonprovisional patent application entitled "Combination Toy Building Block and Container for Holding Liquids and the Like", filed on Jan. 13, 2003, having Ser. No. 10/341,157, now abandoned, which is a continuation of and claims priority to and benefit of non-provisional patent application entitled "Combination Toy Building Block and Container for Holding Liquids and the Like", filed Nov. 29, 2001, having assigned Ser. No. 10/021,816 and newly issued as U.S. Pat. No. 6,506,091.

TECHNICAL FIELD

The present invention relates generally to containers, and more specifically to a combination toy building block and container for holding liquids and the like.

BACKGROUND OF THE INVENTION

Most parents would probably agree that a child's creative mind could turn almost any common household item into a toy. From soup-can-telephones to cardboard-box-racecars to blanket-broom-forts, most children can typically turn common household items into wondrous and imaginative creations.

Containers in general, have been traditionally recognized as serving one primary purpose: containing or holding substances such as liquids or granulates. More often than not, after depletion of a container's contents, the empty container is deemed useless and thus discarded, thereby becoming an environmental burden. Those retained may serve limited uses as temporary canisters for miscellaneous items or as accessories for a child's arts and crafts. However, even if employed in a child's arts and crafts, most containers have limited functionality, and typically do not serve as entertaining toys.

Therefore, it is readily apparent that there is a need for a combination toy building block and container for holding liquids and the like, wherein the container has a functional configuration that allows it to both carry a dispensable substance and be interlockingly stacked on similar containers for building most any play toy such as, but not limited to, play forts/houses, play cars and boats, statues, tables and chairs.

BRIEF SUMMARY OF THE INVENTION

Briefly described, in a preferred embodiment, the present invention overcomes the above-mentioned disadvantages, and meets the recognized need for such a device by providing a combination toy building block and container for holding liquids and the like, wherein the functional configuration of the device permits both the carrying of a dispensable substance and the stacking of multiple containers, thereby enabling the imaginative play construction of buildings and objects such as, but not limited to, play forts, play houses, play cars and boats, statues, tables and chairs.

According to its major aspects and broadly stated, the present invention in its preferred form is a combination toy building block and container for holding liquids and the like having cooperatively engageable male connectors, female receptacles, spout portion and spout receptacle.

More specifically, the present invention is a combination toy building block and container for holding liquids and the like having male connectors formed on one side of the container and female receptacles formed on an opposing side thereof. The container further preferably provides a lidded or spout portion formed thereon, and a recessed area or spout receptacle formed opposite therefrom. Preferably, a plurality of such containers each possessing correspondingly dimensioned male connectors, female receptacles, spout portion and spout receptacle can be utilized as toy building blocks, wherein each such container is connected to one another and/or stacked by selectively engaging the male connectors of a first container with the female receptacles of a second container, the spout portion of a first container with a selected female receptacle of a second container, the spout portion of a first container with the spout receptacle of a second container, and/or a male connector of a first container with the spout receptacle of a second container, and so on, until a plurality of such containers have been similarly engaged to yield the desired building block structure.

An alternate embodiment of the present invention provides a container having a male connector formed on one side thereof and female receptacles formed on an opposing side therefrom, wherein a handle formed proximate to the male connector is dimensioned to be received within one female receptacle of a second container. A plurality of such containers each possessing correspondingly dimensioned female receptacles, male connector and handle can be connected to one another and/or stacked by engaging the male connector of a first container with a female receptacle of a second container, and/or the handle of a first container with one of the female receptacles of a second container, and so on, essentially providing toy building blocks.

Another alternate embodiment of the present invention provides a container having male connectors formed on one side thereof and female receptacles formed on an opposing side therefrom, wherein a handle formed and recessed within one of the female receptacles is dimensioned to be received within one of a plurality of channels formed on each male connector upon engagement of a plurality of such containers.

A feature and advantage of the present invention is its ability to provide a toy building block.

A feature and advantage of the present invention is its ability to carry and hold liquids, granulates or any other suitably selected substance.

A feature and advantage of the present invention is its ability to be generally interlockingly-connected to correspondingly-dimensioned toy building block containers.

A feature and advantage of the present invention is its ability to be easily utilized by children.

A feature and advantage of the present invention is its ability to provide access to container contents for quick and easy dispensing thereof.

A feature and advantage of the present invention is its ability to be reused as a storage receptacle by simply refilling the container with a desired substance.

A feature and advantage of the present invention is its ability to function as a container yet possess an aesthetically pleasing appearance, thereby facilitating a child's belief that the container is a genuine toy building block.

A feature and advantage of the present invention is its ability to provide a plurality of containers with selectively and cooperatively engageable male connectors, female connectors, spout portions, and spout receptacles.

A feature and advantage of the present invention is its ability to provide a container with a protruding handle dimensioned to be received within a female receptacle, wherein the handle will not interfere with the connection and/or stacking of multiple containers, thereby enabling the containers to be used as toy building blocks or to be stacked for transport from one location to another.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
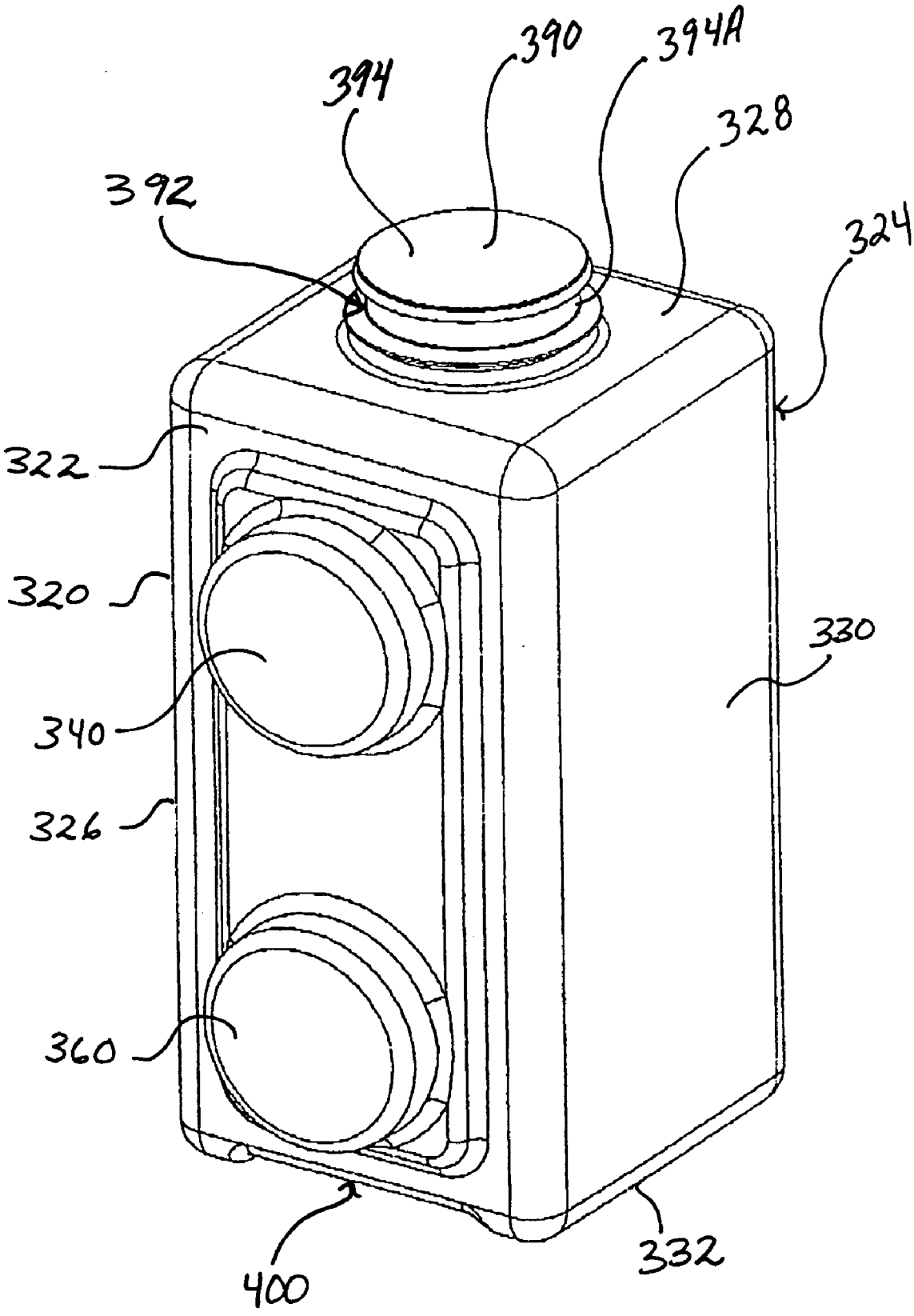
FIG. 1 is a front perspective view of a combination toy building block and container for holding liquids and the like according to a preferred embodiment of the present invention.

In describing the preferred and alternate embodiments of the present invention, as illustrated in FIGS. 1–15, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–4, the present invention in a preferred embodiment is a device 300 generally comprising container 320, male connectors 340 and 360, female receptacles 370 and 380, spout portion 390 and spout receptacle 400.

Specifically, container 320 is preferably substantially block-shaped and comprises top side 322, bottom side 324, sidewalls 326, 328, 330 and 332, wherein sidewalls 326, 328, 330 and 332, top side 322 and bottom side 324 collectively form container 320.

Top side 322 of container 320 has disposed thereon male connectors 340 and 360, wherein male connectors 340 and 360 are preferably substantially cylindrical-shaped, and dimensioned to be interchangeably received by female receptacles 370 and 380, as more fully described below.

Figure 2:
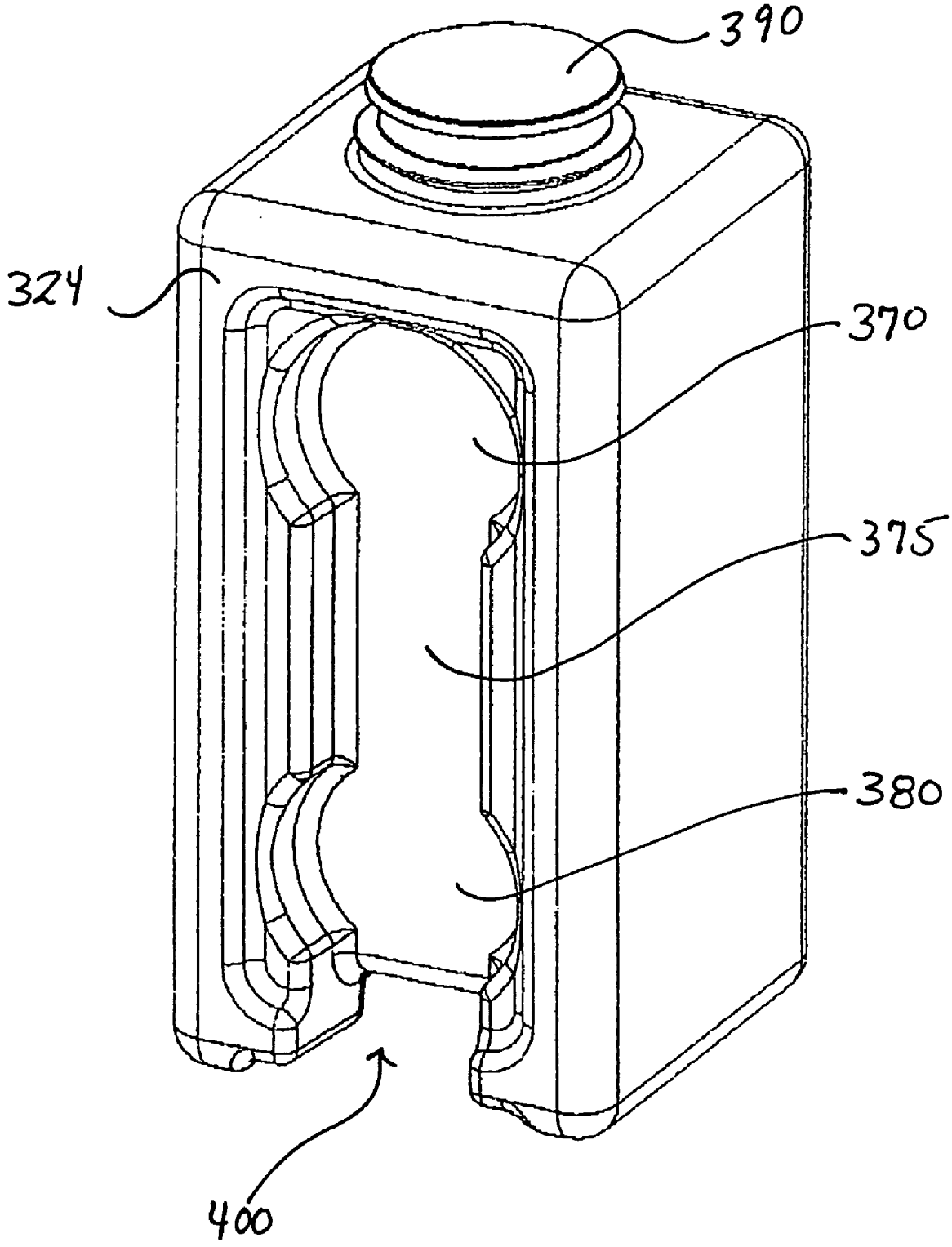
FIG. 2 is a rear perspective view of a combination toy building block and container for holding liquids and the like according to a preferred embodiment of the present invention.
Figure 4:
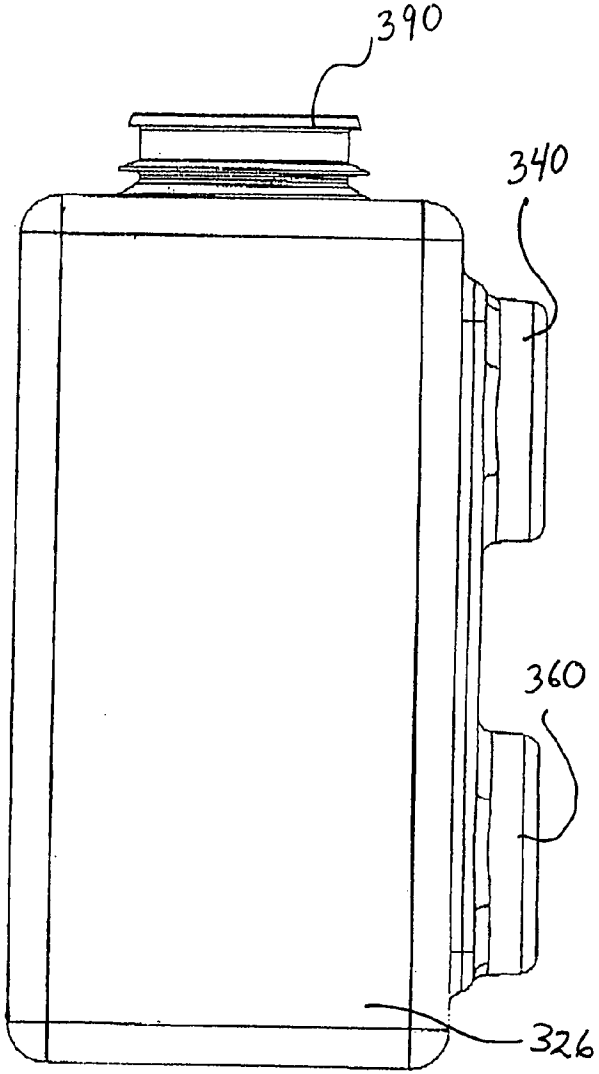
FIG. 4 is a side view of a combination toy building block and container for holding liquids and the like according to a preferred embodiment of the present invention.
Figure 5:
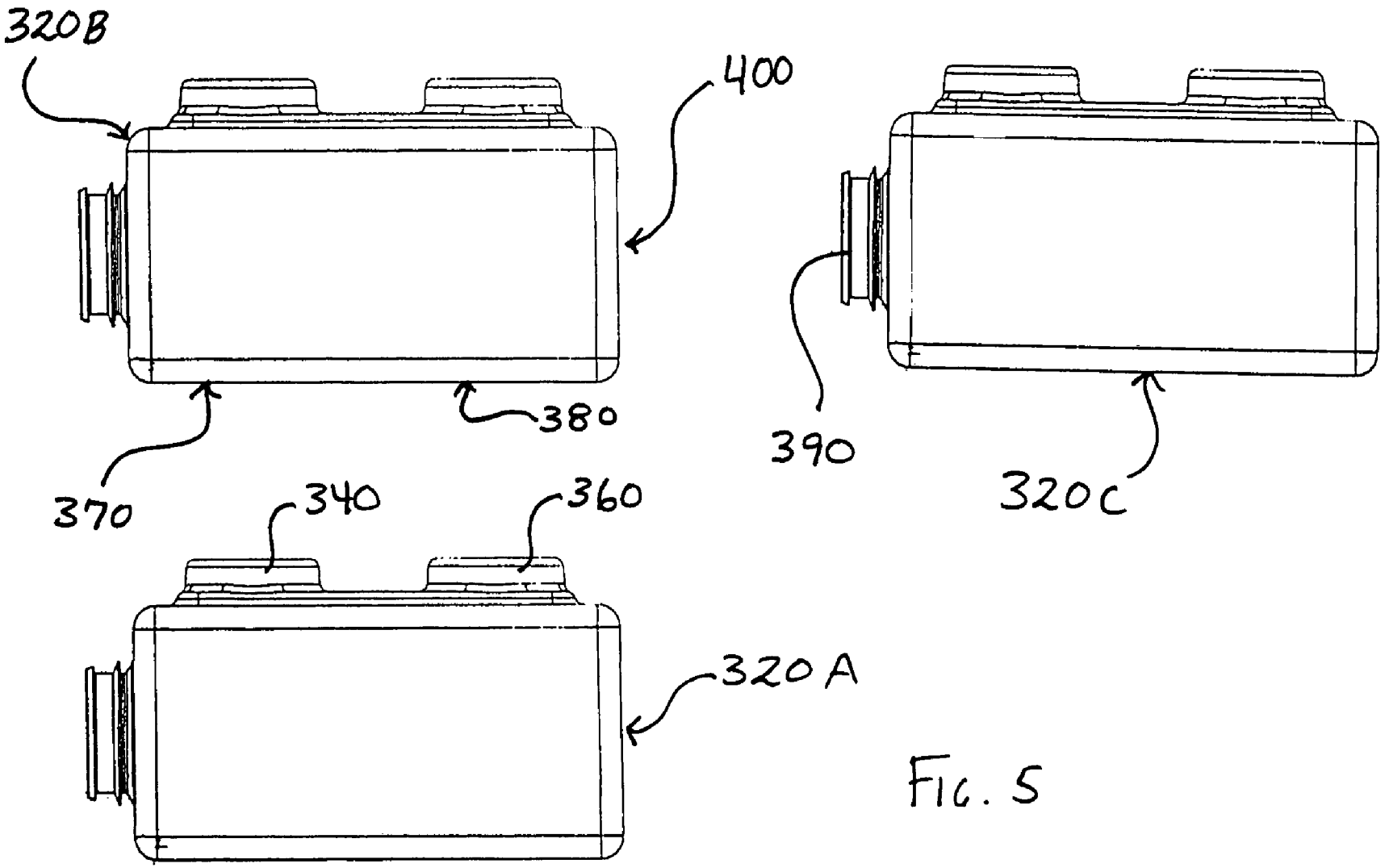
FIG. 5 is a side view of more than one combination toy building block and container for holding liquids and the like according to a preferred embodiment of the present invention, shown in use.

Preferably formed on bottom side 324 of container 320 are aligned and equally-spaced female receptacles 370 and 380, wherein female receptacles 370 and 380 are preferably in fluid communication or interconnected via channel 375 formed therebetween, as best illustrated in FIG. 2. Female receptacles 370 and 380 are preferably substantially cylindrical-shaped and dimensioned to receive male connectors 340 and 360, respectively, or vice versa, of a second container 320, therein, as best illustrated in FIG. 5, and as more fully described below. Although the preferred shape of female receptacles 370 and 380 is cylindrical, it is contemplated in an alternate embodiment that other suitable three-dimensional shapes could be utilized, such as, for exemplary purposes only, triangular, square or diamond, wherein male connector 340 and 360 of a second container 320 could possess equivalent shapes for accommodation of the alternately-shaped female receptacles 370 and 380, respectively, or vice versa.

Preferably formed on sidewall 328 is substantially cylindrical-shaped spout portion 390 having aperture 392 formed therein and therethrough, wherein removably securable cap 394 preferably engages spout 390 to close off aperture 392. Aperture 392 provides the obvious function of permitting the dispensing and/or introduction of liquids or other substances into container 320. Cap 394 is preferably a snap-tight cap, wherein tear-away strip 394A is preferably integrally formed therewith to facilitate the effective closure or sealing of container 320 by cap 394 during initial manufacture and following the filling of container 320 with the desired liquid, or the like, as known within the art. Although snap-tight cap 394 is preferred, it is contemplated that any suitable closure means could be utilized, such as, for exemplary purposes only, screw-type cap, stopper, hinged-lid, or the like.

Figure 3:
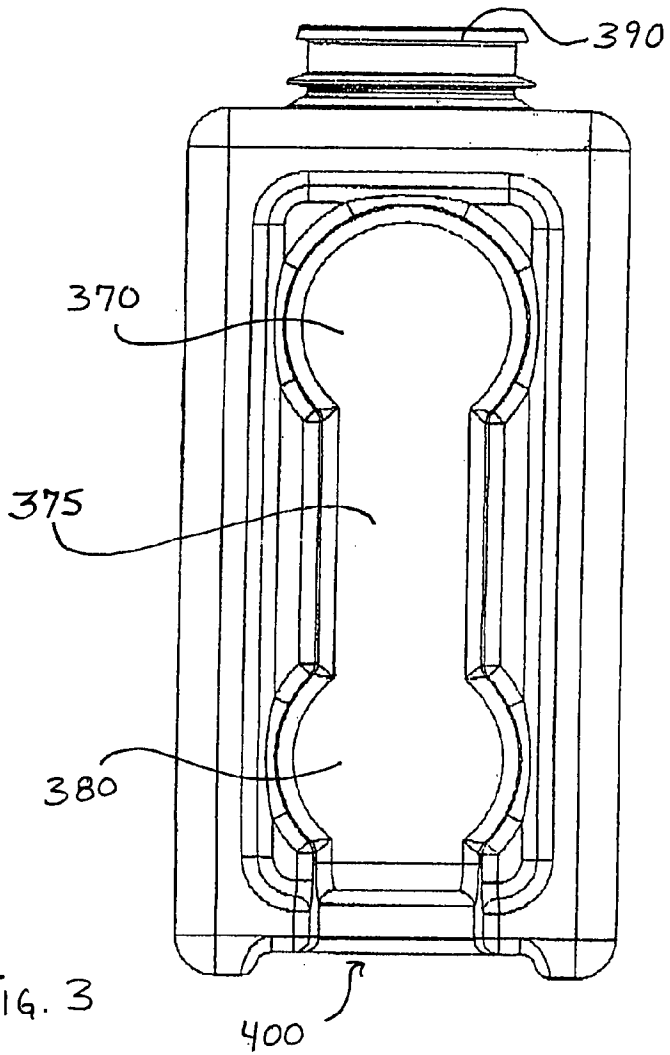
FIG. 3 is a rear view of a combination toy building block and container for holding liquids and the like according to a preferred embodiment of the present invention.

As best illustrated in FIGS. 2–3, spout portion 390 is preferably dimensioned to be received by cylindrical-shaped recess or spout receptacle 400, preferably formed on sidewall 332 and in fluid communication with female receptacles 370 and 380. As such spout portion 390 of a first container 320, capped or uncapped via cap 394, may be inserted or engaged with a spout receptacle 400 of a second container 320 without interfering with the joining of the male connectors 340 and 360 of a third container 320 to the female receptacles 370 and 380 of the second container 320, as more fully described below with reference to FIG. 5.

Referring now to FIG. 5, when container 320 is being utilized as a toy building block, first container 320A is connected to second container 320B by engaging male connectors 340 and 360 of first container 320A with female receptacles 370 and 380, respectively, or vice versa, of second container 320B, such that male connectors 340 and 360 substantially recess within female receptacles 370 and 380, respectively, or vice versa, to removably interlock first container 320A with second container 320B. Additionally, capped or uncapped spout portion 390 of a third container 320C may be engaged to spout receptacle 400 of second container 320B or, alternatively, spout receptacle 400 of first container 320A. Numerous such containers 320 may be connected in such a manner. Alternatively, container 320A and container 320B may be connected via insertion of either male connector 340 or 360 of container 320A into any one of female receptacles 370 or 380 of container 320B. In another configuration, either male connector 340 or 360 of container 320A may be inserted into either female receptacle 270 or 280, or spout receptacle 400, of container 220B so as to form an L-shaped building block configuration. In yet another configuration, spout portion 390 of container 320A may be inserted into either female receptacle 370 or 380 of container 220B so as to also form an L-shaped building block configuration. In essence, multiple containers 320 can be connected and built upon one another to create a multitude of toy building block configurations.

Figure 6:
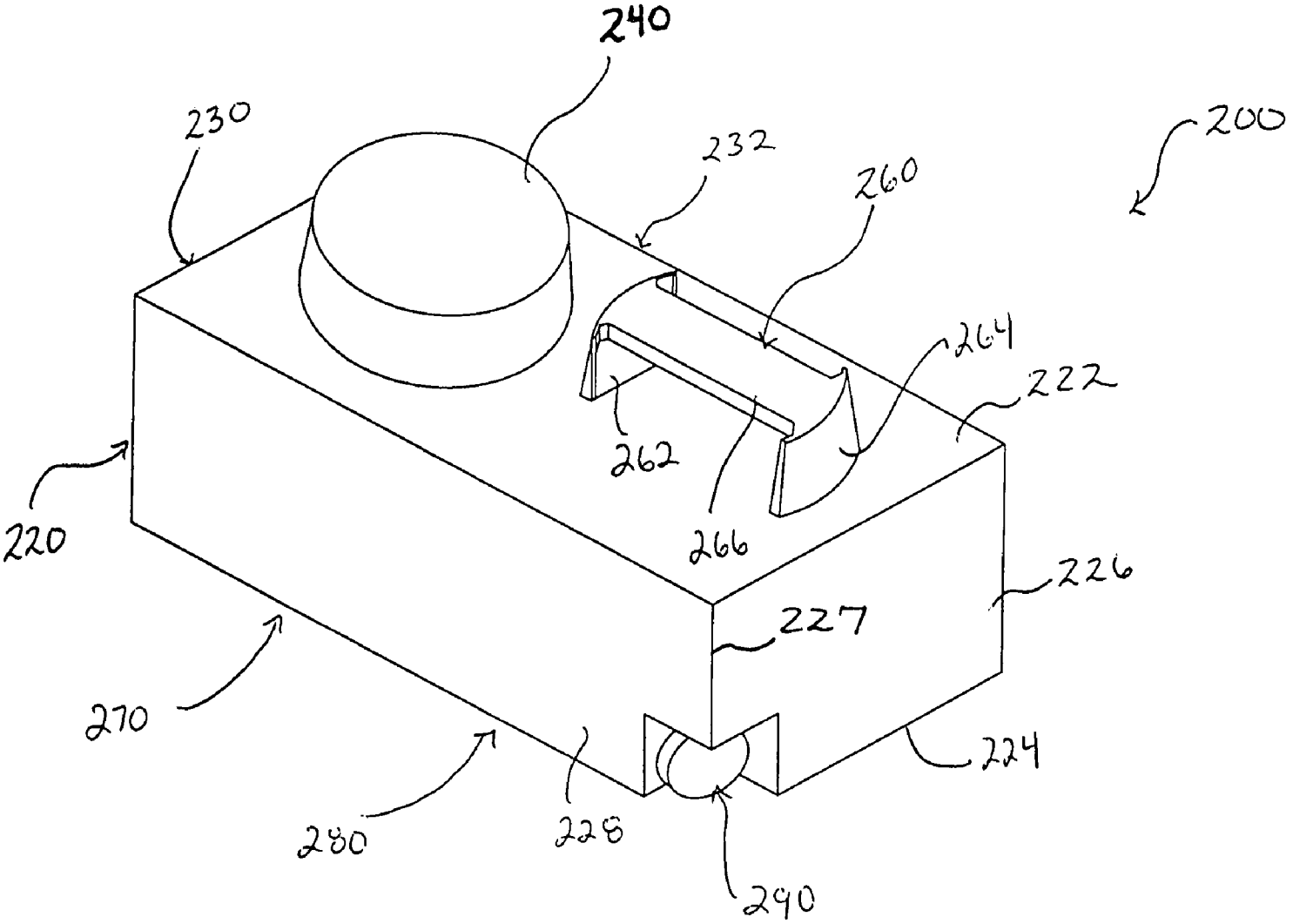
FIG. 6 is a perspective view of a combination toy building block and container for holding liquids and the like according to an alternate embodiment of the present invention.
Figure 7:
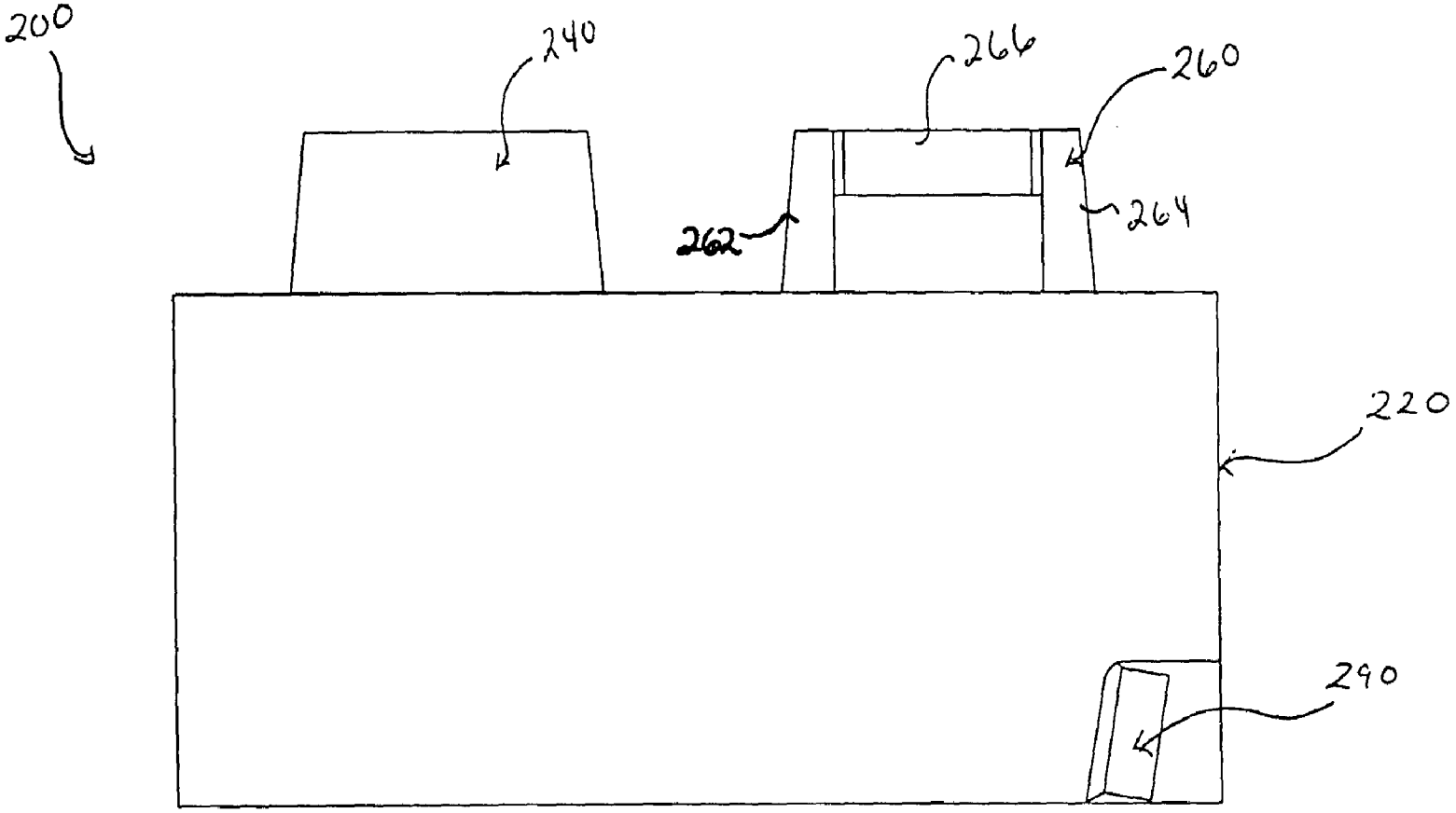
FIG. 7 is a side view of a combination toy building block and container for holding liquids and the like according to an alternate embodiment of the present invention.
Figure 8:
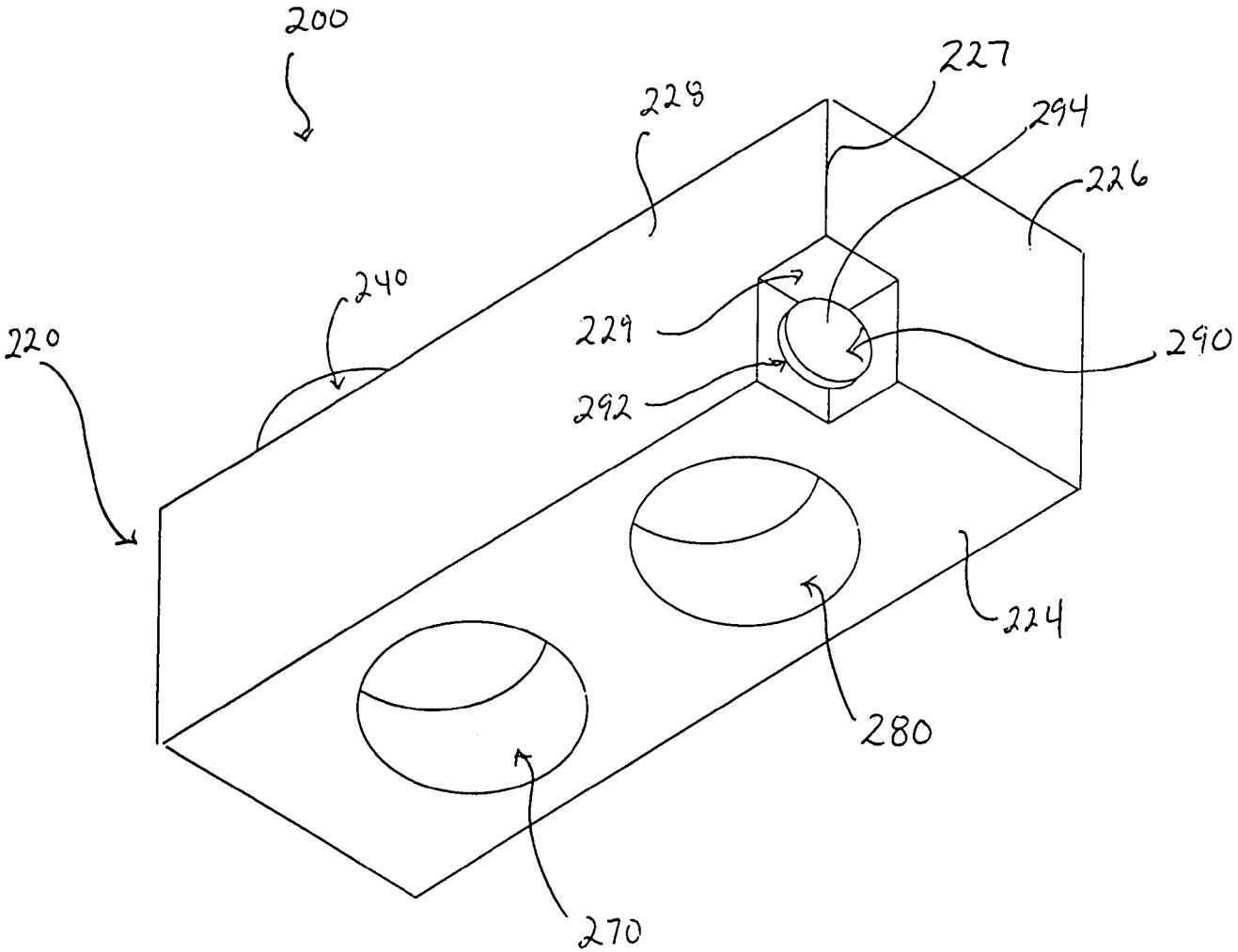
FIG. 8 is a perspective view of a combination toy building block and container for holding liquids and the like according to an alternate embodiment of the present invention.

Referring now to FIGS. 6-8, the present invention in an alternate embodiment is device 200 generally comprising container 220, male connector 240, handle 260, female receptacles 270 and 280, and spout 290.

Specifically, container 220 is substantially block-shaped and comprises top side 222, bottom side 224, sidewalls 226, 228, 230 and 232, wherein sidewalls 226, 228, 230 and 232, top side 222 and bottom side 224 collectively form container 220.

Top side 222 of container 220 has disposed thereon male connector 240 and handle 260, wherein male connector 240 is substantially cylindrical-shaped, and wherein handle 260 is truncated-cylindrical-shaped, having an overall size and height substantially equivalent to male connector 240. More specifically, handle 260 possesses generally arcuate-shaped support walls 262 and 264, wherein handle portion 266 is integrally formed and positioned therebetween. As a result of the general arcuate/cylindrical shape of handle 260, and its general equivalence in size and height to male connector 240, handle 260 is adapted to be impartially received by either female receptacle 270 or 280, as more fully described below.

Figure 9:
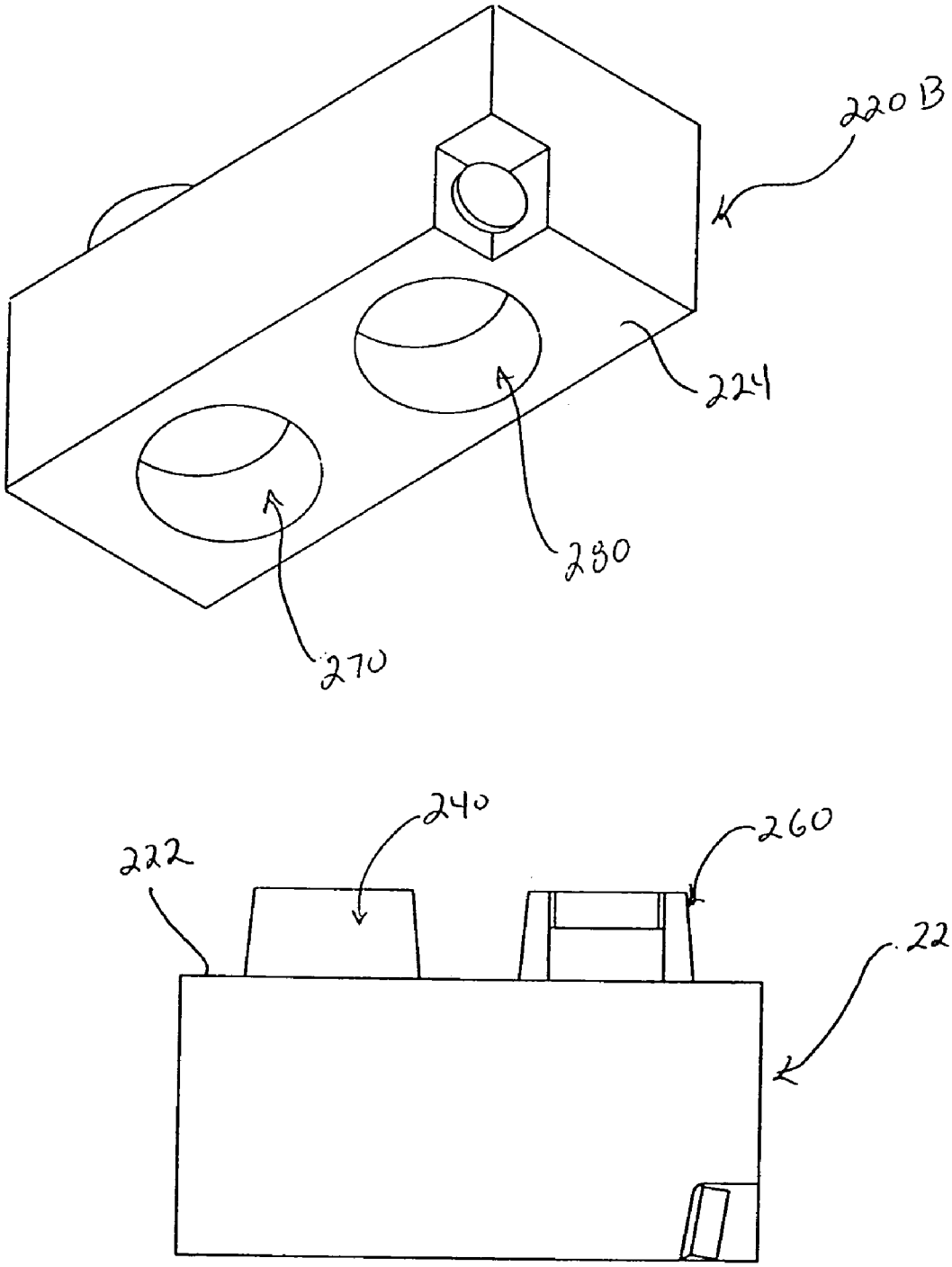
FIG. 9 is a perspective view of more than one combination toy building block and container for holding liquids and the like according to an alternate embodiment of the present invention, shown in use.
Figure 10:
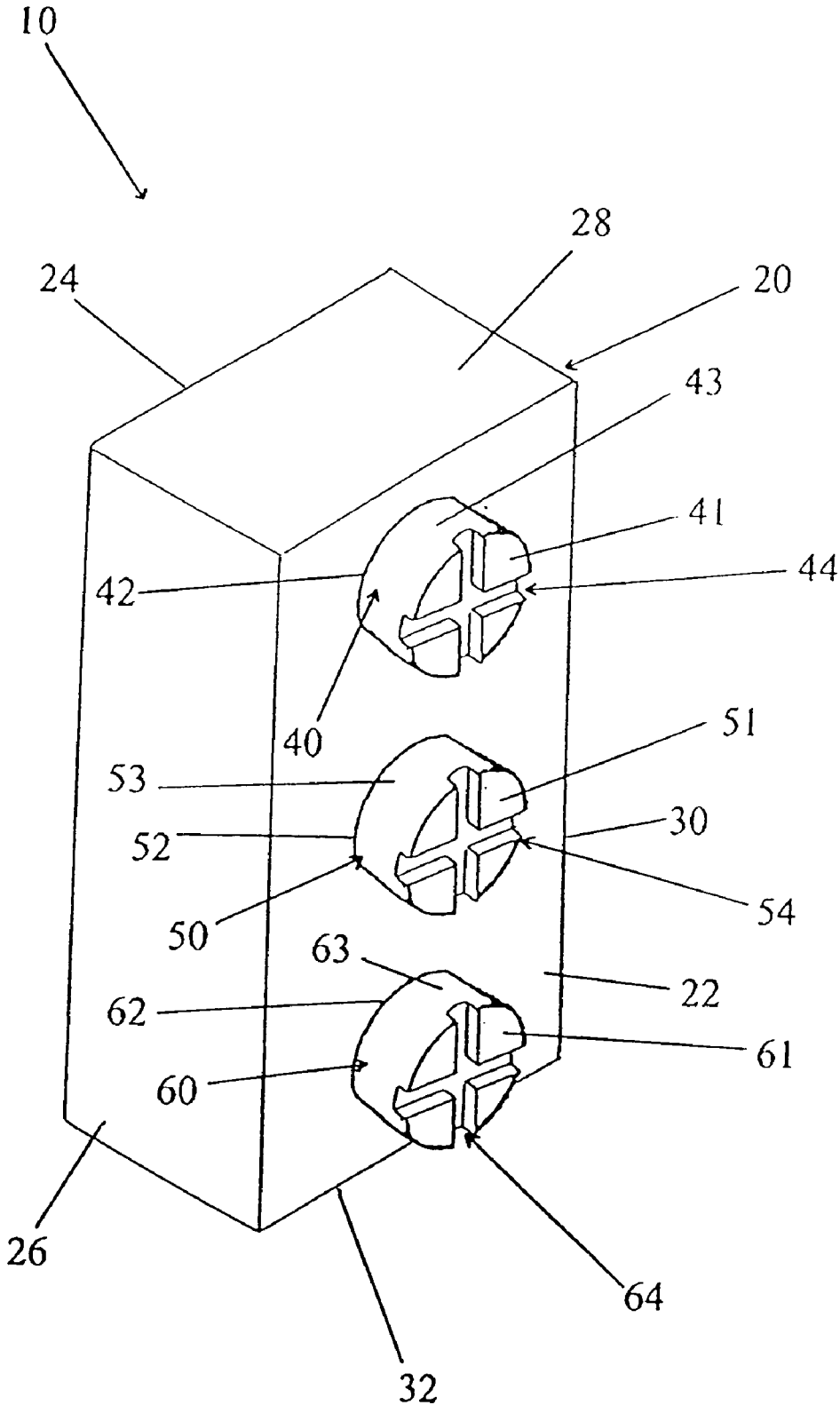
FIG. 10 is a front perspective view of a combination toy building block and container for holding liquids and the like according to an alternate embodiment of the present invention.
Figure 11:
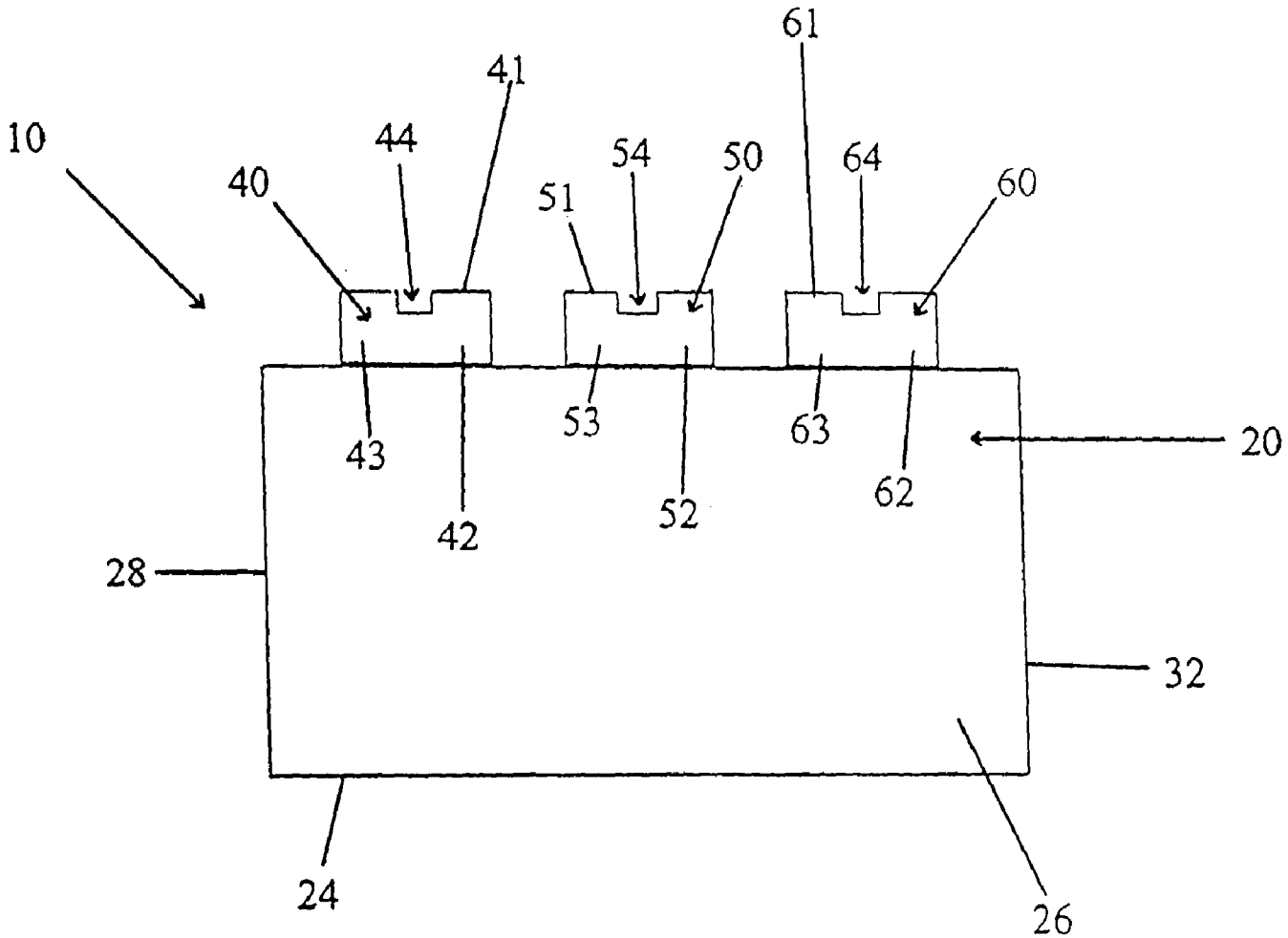
FIG. 11 is a side view of a combination toy building block and container for holding liquids and the like according to an alternate embodiment of the present invention.
Figure 12:
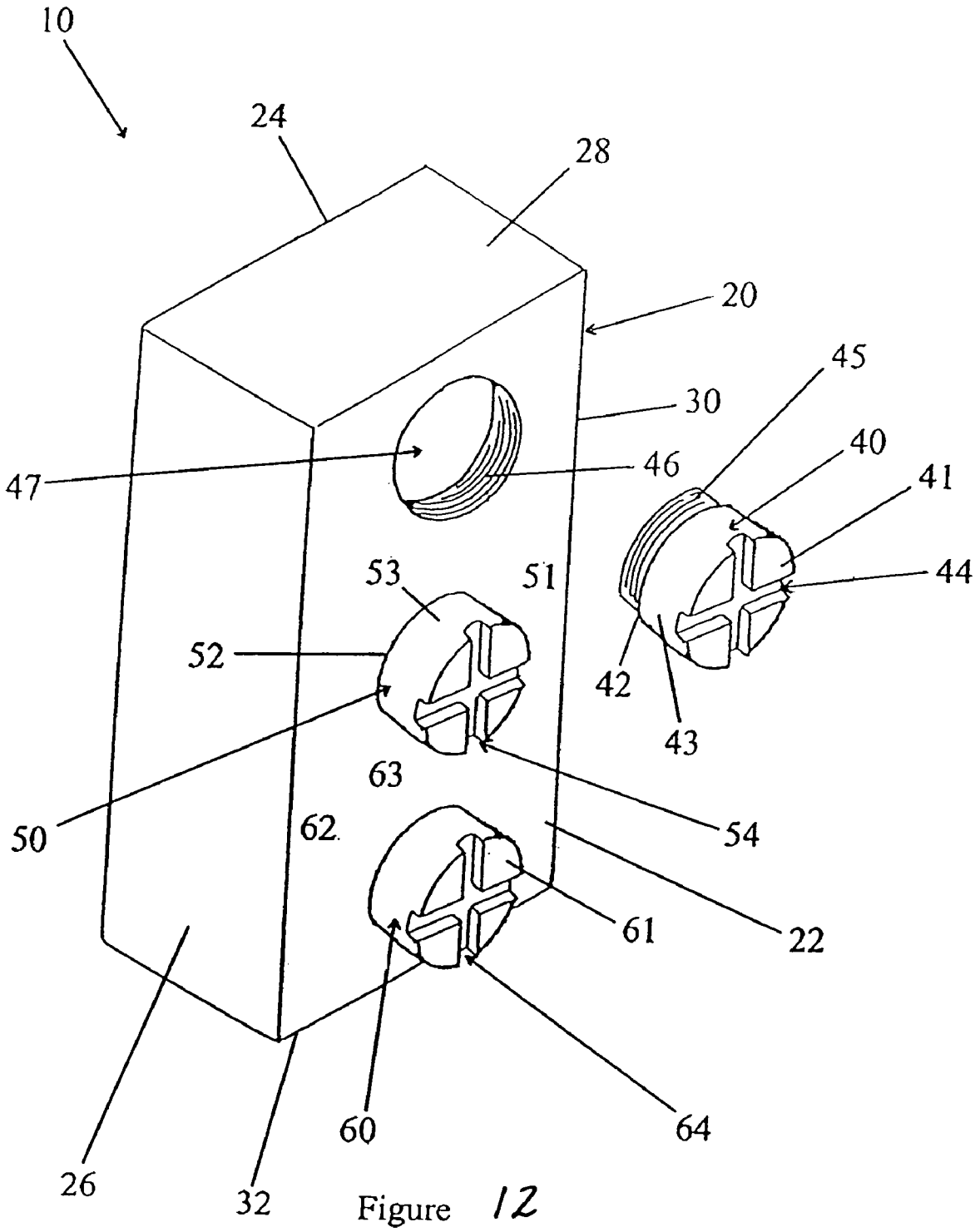
FIG. 12 is a front perspective view of a combination toy building block and container for holding liquids and the like according to an alternate embodiment of the present invention showing one of the male connectors unscrewed.
Figure 13:
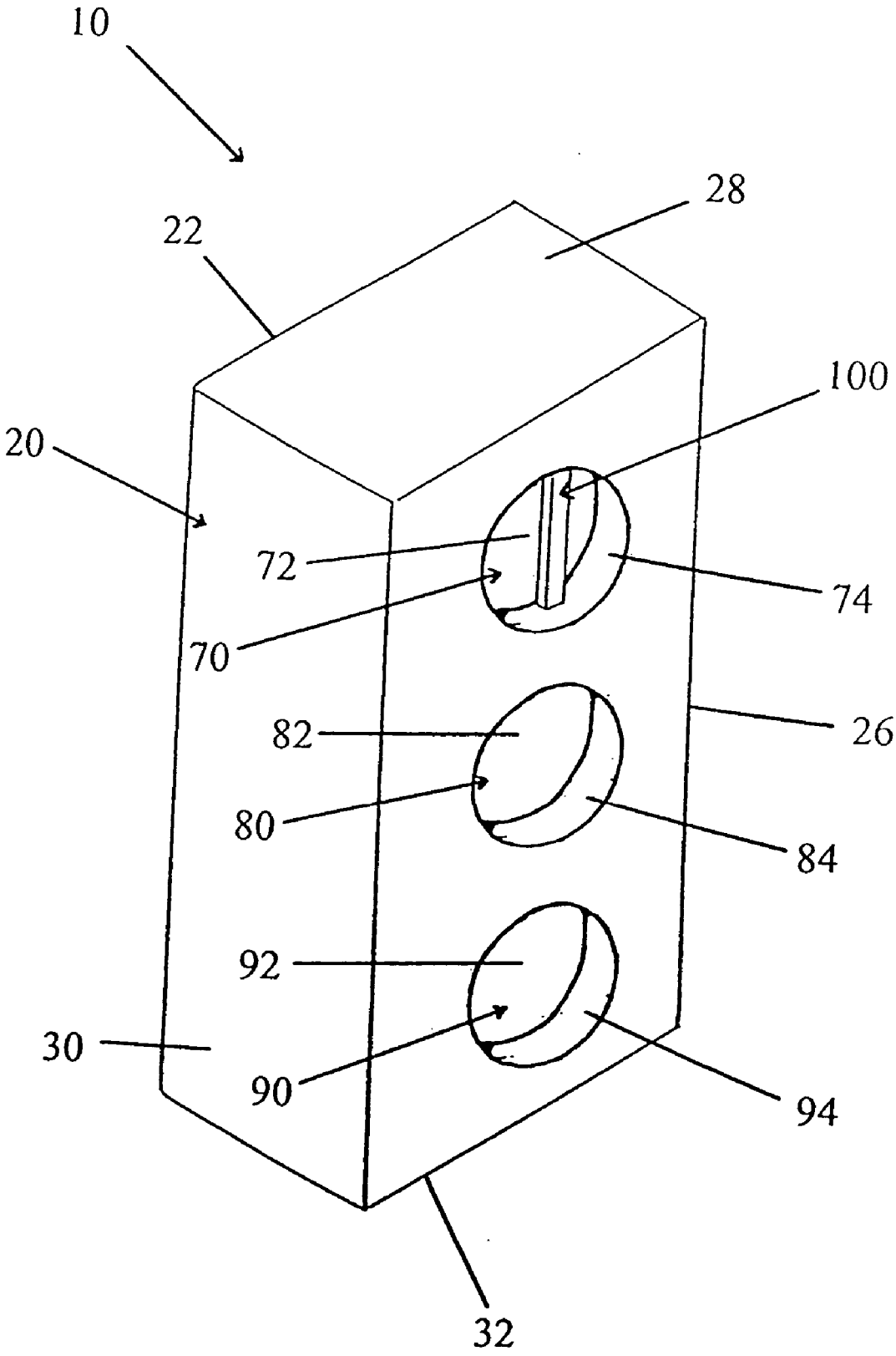
FIG. 13 is a back perspective view of a combination toy building block and container for holding liquids and the like according to an alternate embodiment of the present invention showing a handle recessed within one of the female receptacles.

Formed on bottom side 224 of container 220 are aligned and equally-spaced female receptacles 270 and 280, wherein female receptacles 270 and 280 are substantially cylindrical-shaped and dimensioned to receive male connector 240 and handle 260, respectively, or vice versa, of a second container 220, therein, as best illustrated in FIG. 9, and as more fully described below. Although the shape of female receptacles 270 and 280 is cylindrical, it is contemplated in an alternate embodiment that other suitable three-dimensional shapes may be utilized, such as, for exemplary purposes only, triangular, square or diamond, wherein male connector 240 and handle 260 of a second container 220, would possess equivalent shapes for accommodation of female receptacles 270 and 280, respectively, or vice versa.

Formed at intersecting edge 227 of sidewalls 226 and 228, and partially into bottom side 224, is cutaway 229, wherein cutaway 229 has aperture 292 of spout 290 formed therein and therethrough, and wherein removably securable cap 294 closes off aperture 292. Aperture 292 presents the obvious function of permitting the dispensing and/or introduction of liquids or other substances into container 220. Cap 294 is any suitable closure means known within the art, such as, for exemplary purposes only, screw-type cap, snap-tight cap, stopper, or the like. As best illustrated in FIG. 7, spout 290, in general, sits sufficiently flush with bottom side 224 of container 220, and well within cutaway 229, so as to not interfere with the joining and stacking of multiple containers 220, as more fully detailed below.

Referring now to FIG. 9, when container 220 is being utilized as a toy building block, first container 220A is connected to second container 220B by engaging male connector 240 and handle 260 of container 220A with female receptacles 270 and 280, respectively, or vice versa, of container 220B, such that male connector 240 and handle 260 substantially recess within female receptacles 270 and 280, respectively, or vice versa, to removably interlock first container 220A with second container 220B, wherein top side 222 of container 220A is proximate to bottom side 224 of second container 220B. Numerous such containers 220 may be connected in such a manner. Alternatively, first container 220A and second container 220B may be connected via insertion of male connector 240 of container 220A into any one of female receptacles 270 or 280 of container 220B. In another configuration, first container 220A and second container 220B may be connected via insertion of male connector 240 or handle 260 of container 220A into female receptacle 270 or 280 of container 220B so as to form an L-shaped building block configuration. In essence, multiple containers 220 can be connected and built upon one another to create a multitude of toy building block configurations.

Referring now to FIGS. 10–13, the present invention in another alternate embodiment is device 10, wherein device 10 is a combination toy building block and container for holding liquids and the like generally comprising container 20, male connectors 40, 50 and 60, female receptacles 70, 80 and 90 and handle 100.

Specifically, container 20 is substantially block-shaped and comprises top side 22, bottom side 24, sidewalls 26, 28, 30 and 32, wherein sidewalls 26, 28, 30 and 32, top side 22 and bottom side 24 together form container 20. It is recognized that container 20 may define an alternate, suitable three-dimensional shape such as, for exemplary purposes only, square, triangular, cylindrical, diamond or trapezoidal. Further, although container 20 is formed from plastic material, it is contemplated in alternate embodiments that container 20 can be formed from any suitable material known within the art, such as, for exemplary purposes only, other synthetic material, metal or wood.

Top side 22 of container 20 has disposed thereon three aligned and equally spaced male connectors 40, 50 and 60, wherein male connectors 40, 50 and 60 are substantially cylindrical-shaped. Although container 20 possesses three aligned and equally-spaced male connectors, it is contemplated in alternate embodiments that container 20 could contain any number of male connectors and that such connectors could be in an unequally-spaced and/or unaligned configuration such as, for exemplary purposes, a domino or die configuration. Male connectors 40, 50 and 60 comprise a top surface 41, 51 and 61, respectively, a bottom surface 42, 52 and 62, respectively, and a peripheral side wall 43, 53 and 63, respectively, adjoining respective top surfaces 41, 51 and 61 and bottom surfaces 42, 52 and 62. Formed on top surfaces 41, 51 and 61 are X-shaped channels 44, 54, and 64, respectively. Although the shape of channels 44, 54 and 64 is X-shaped, it is contemplated in alternate embodiments that channels 44, 54 and 64 could be any shape, such as, for exemplary purposes only, I-shaped, V-shaped or any other suitable shape.

Formed on bottom surface 42 of male connector 40 is threaded engagement 45, dimensioned for reception by threaded interface 46 formed on top side 22 of container 20. Although the shape of male connectors 40, 50 and 60 is cylindrical, it is contemplated in alternate embodiments that other suitable three-dimensional shapes may be used, such as, for exemplary purposes only, triangular, square or diamond, wherein threaded engagement 45 would retain a generally cylindrical shape facilitating reception by threaded interface 46.

Male connector 40 is removed from container 20 via separation of threaded engagement 45 from threaded interface 46, thus allowing access to and/or dispensing of the contents of container 20 via aperture 47. Although male connector 40 alone comprises threaded engagement 45 to removably secure to container 20 via threaded interface 46, thereby enabling access to the contents of container 20, it is contemplated in an alternate embodiment that male connector 50, male connector 60 or any combination of male connectors 40, 50 and 60 could comprise threaded engagements formed thereon for engagement with and/or removal from respective threaded interfaces formed on top side 22 of container 20 to permit additional access to the contents of container 20. Moreover, while a threaded mechanism is contemplated, alternate means of removably securing male connectors 40, 50 and/or 60 to container 20 could be utilized, such as, for exemplary purposes only, rubberized pressure sensitive ridges or pressure sensitive locking beads. Alternatively, male connectors 50 and 60 could be integrally formed with container 20.

Bottom side 24 of container 20 has defined thereon three aligned and equally-spaced female receptacles 70, 80 and 90, wherein female receptacles 70, 80 and 90 are substantially cylindrical-shaped and dimensioned to receive male connectors 40, 50 and 60 of a second container 20 or a similar container possessing similarly dimensioned and similarly aligned male connectors. Although the shape of female receptacles 70, 80 and 90 is cylindrical, it is contemplated in alternate embodiments that other suitable three-dimensional shapes may be used, such as, for exemplary purposes only, triangular, square or diamond, wherein the contemplated shape corresponds to the shape of male connectors 40, 50 and 60 of a second container 20 or a similar container possessing similarly dimensioned and similarly aligned male connectors. Furthermore, although container 20 possesses three female receptacles, it is contemplated in an alternate embodiment that container 20 could contain any number of female receptacles, and that any such receptacles could be alternately spaced or aligned, wherein an appropriate corresponding relationship remains with male connectors 40, 50 and/or 60 as required.

Specifically, female receptacles 70, 80 and 90 are defined by a bottom wall 72, 82 and 92, respectively, and peripheral sidewall 74, 84 and 94, respectively. Handle 100 is attached to peripheral sidewall 74 of female receptacle 70 in a generally recessed position. Handle 100 is elongated rectangular-shaped and is dimensioned to be received within either one of X-shaped channel 44, 54 or 64 of inserted male connector 40, 50 or 60, respectively. Handle 100 extends across female receptacle 70 substantially parallel with sidewalls 26 and 30, wherein a first end thereof is proximate sidewall 28 of container 20. Alternatively, handle 100 could extend across female receptacle 70, substantially perpendicular to sidewalls 26 and 30 and substantially parallel with sidewalls 28 and 32.

Although female receptacle 70 comprises handle 100, it is contemplated in an alternate embodiment that female receptacles 80 and 90 could also possess handles attached to peripheral side walls 84 and 94, respectively, and be dimensioned for reception by one channel of X-shaped channel 44, 54 or 64 depending upon which male connector, 40, 50 or 60, respectively, is inserted into female receptacles 80 and 90. It is further contemplated in an alternate embodiment that handle 100 could also be X-shaped for receipt by both channels of one of X-shaped channels 44, 54 or 64 upon connection or stacking of an identical container 20 or similar container possessing similarly dimensioned and similarly aligned male connectors. Additionally, channels 44, 54 or 64 could be most any suitable shape such as, for exemplary purposes only, plus symbol shaped or I-shaped. Furthermore, female receptacles 70, 80 and 90 could possess raised portions recessed therein and dimensioned to be received within channels 44, 54 and 64 of male connectors 40, 50 and 60.

Figure 14:
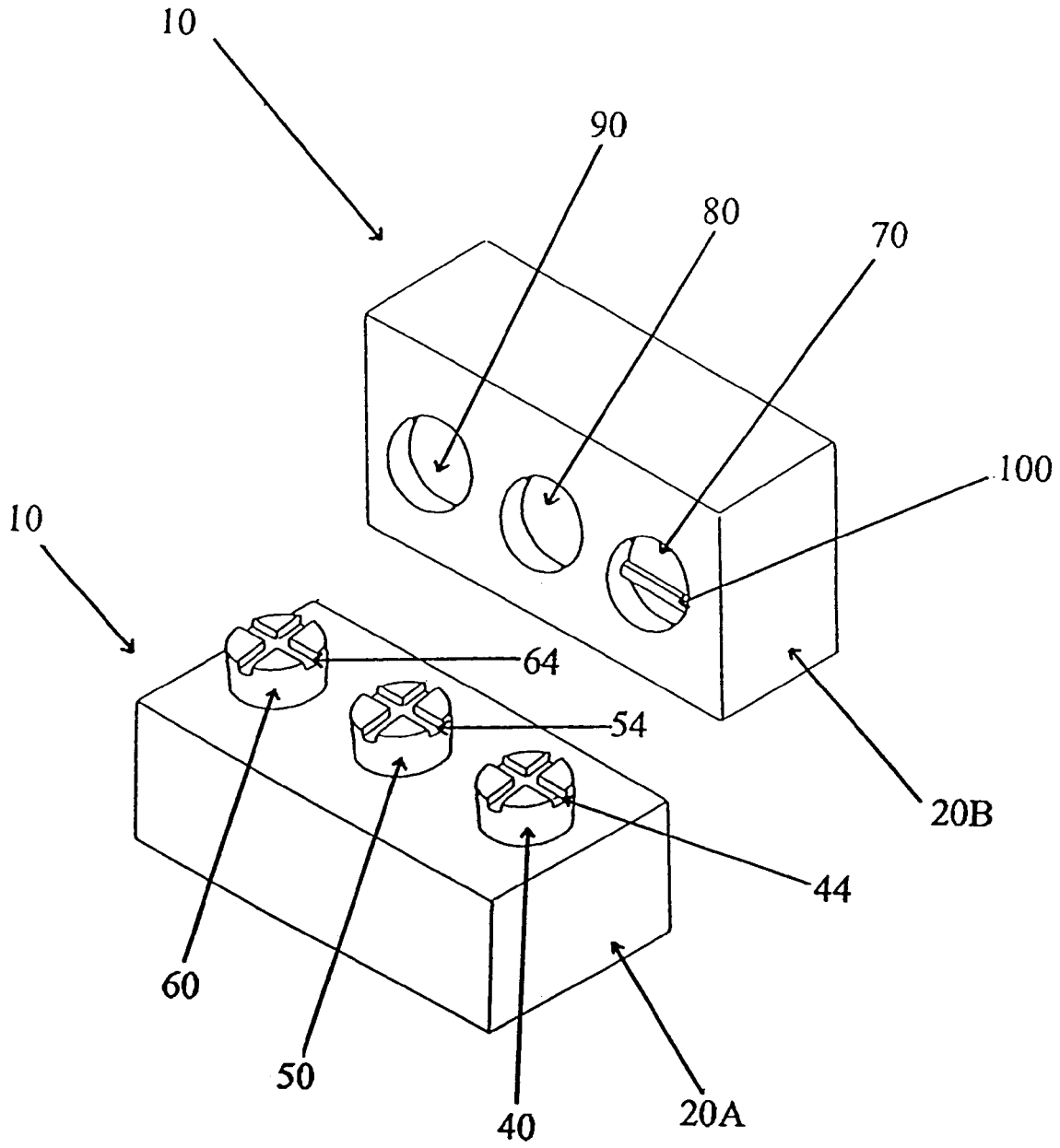
FIG. 14 is a side perspective view of more than one combination toy building block and container for holding liquids and the like according to an alternate embodiment of the present invention, shown in use; and, FIG. 15 is a front perspective view of a combination toy building block and container for holding liquids and the like according to an alternate embodiment of the present invention.

Referring now to FIG. 14, when container 20 is being utilized as a toy building block, first container 20A (or similar container possessing similarly dimensioned and similarly aligned male and female connectors) is removably connected to second container 20B by engaging male connectors 40, 50 and 60 of container 20A with female receptacles 70, 80, and 90, respectively, of container 20B such that male connectors 40, 50 and 60 substantially recess within female receptacles 70, 80, and 90, respectively, to removably interlock first container 20A with second container 20B, wherein top side 22 of container 20A is proximate to bottom side 24 of second container 20B. To interlock first container 20A with second container 20B in an alternate configuration, male connectors 40, 50 and 60 of first container 20A are engaged with female receptacles 90, 80 and 70, respectively, of second container 20B. Numerous such containers 20 may be connected in such a manner. Alternatively, a container 20A and a container 20B may be connected via insertion of a single male connector 40, 50 or 60 of container 20A into any one of female receptacles 70, 80 or 90 of container 20B. Further, a container 20A and a container 20B may be connected via insertion of two adjacent male connectors 40 and 50 or 50 and 60 of container 20A into any two adjacent female receptacles 70 and 80 or 80 and 90, respectively, of container 20B. Moreover, a container 20A and a container 20B may be connected via insertion of male connector 50 of container 20A into female receptacle 80 of container 20B so as to form an X-shaped building block configuration. In yet another configuration, a container 20A and a container 20B may be connected via insertion of male connector 40 or 60 of container 20A into female receptacle 70 or 90, respectively, of container 20B so as to form an L-shaped building block configuration. In essence, multiple containers 20 can be connected and built upon one another to create a multitude of toy building block configurations.

Figure 15:
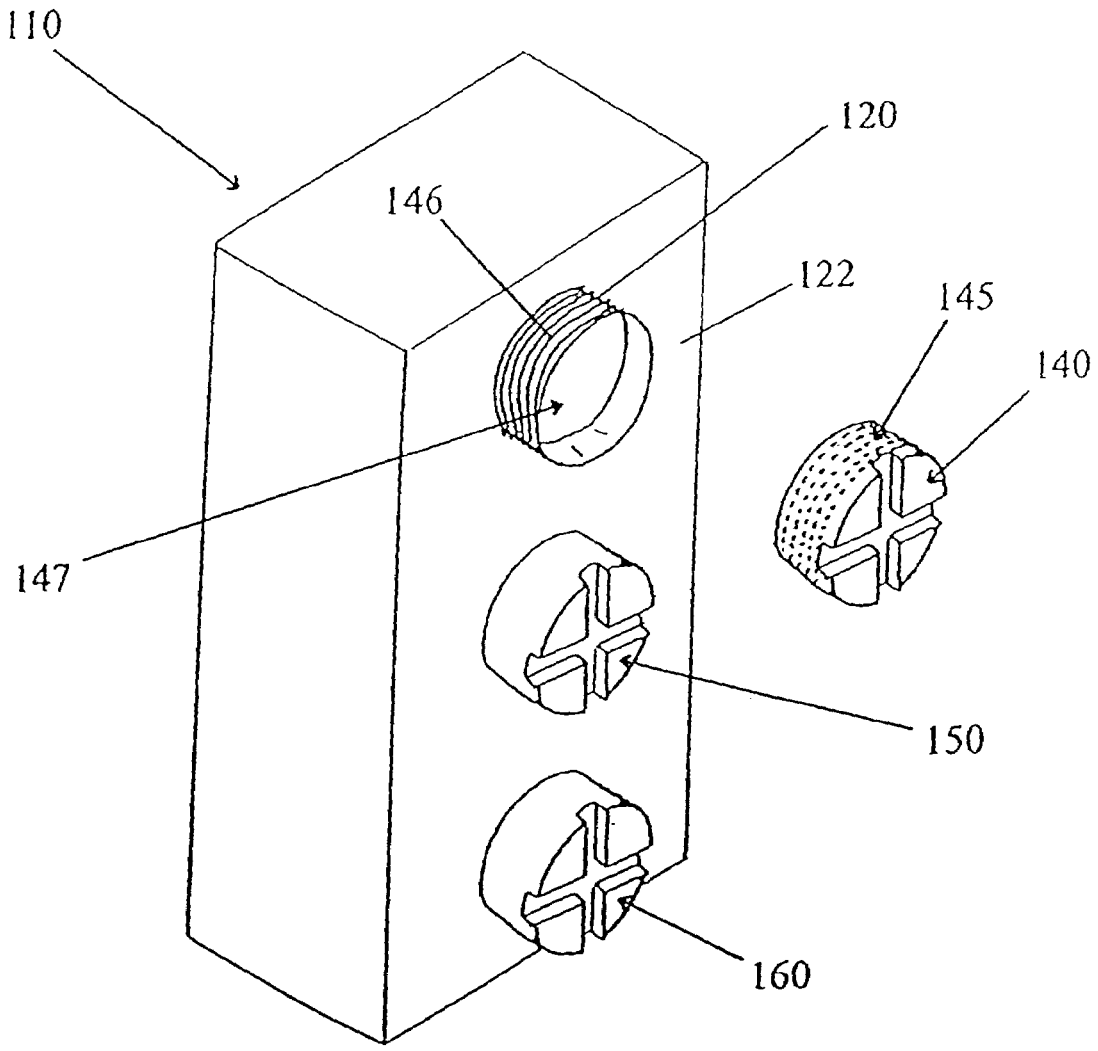

Referring now to FIG. 15, in still another alternate embodiment, container 120 of device 110 could have male connectors 140, 150 and 160, wherein male connector 140 has internally threaded interface 145 dimensioned to be received by threaded lip 146 formed on top side 122 of container 120, and wherein lip 146 functions as a spout for the pouring and/or dispensing of the contents of container 120. Male connector 140 is removed from container 120 via separation of internally threaded interface 145 of male connector 140 from threaded lip 146 of container 120, thus allowing access to and/or dispensing of the contents of container 120 via aperture 147. Although male connector 140 alone could comprise internally threaded interface 145 to removably secure to container 120 via threaded lip 146 of container 120, thereby enabling access to the contents of container 120, it is further contemplated that male connector 150, male connector 160 or any combination of male connectors 140, 150 and 160 could comprise internally threaded interfaces formed thereon for engagement with and/or removal from respective threaded lips formed on top side 122 of container 120 to permit additional access to the contents of container 120. Moreover, while a threaded mechanism is contemplated, alternate means of removably securing male connectors 140, 150 and/or 160 to container 120 could be utilized, such as, for exemplary purposes only, rubberized pressure sensitive ridges, pressure sensitive locking beads, or alternatively, male connectors 150 and 160 could be integrally formed with container 120.

In another alternate embodiment, top side 22 and bottom side 24 of container 20 could contain rows of male connectors and female connectors, respectively.

In another alternate embodiment, sidewalls 26, 28, 30 and 32 could also contain male connectors or female receptacles so as to increase the number of different configurations in which containers 20 could be connected.

In another alternate embodiment, container 20 could have only one male connector and only one female receptacle provided thereon.

In yet another alternate embodiment, at least one surface or side of container 20 could have at least one male connector and at least one female receptacle provided thereon.

In still another alternate embodiment, container 20 could be manufactured from an opaque or transparent material.

In yet another alternate embodiment, the male connectors could be dome-shaped.

In still another alternate embodiment, the handle could have extending and retracting or telescoping capabilities.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A combination toy building block and container for holding liquids and the like, comprising:

a container having at least one outer wall defining an interior cavity;

at least one cylindrical male member disposed on said container;

a first female receptacle;

a second female receptacle, said first and second female receptacles being cylindrical shaped;

a channel disposed between said first and second female receptacles;

at least one spout portion formed on said container; and, at least one spout receptacle defined on said container, wherein said first female receptacle, said second female receptacle and said spout receptacle are in fluid communication.

2. The combination toy building block and container of claim 1, wherein said at least one cylindrical male member is carried by said outer wall, and wherein said first and second female receptacles are defined opposite thereof on said outer wall.

3. The combination toy building block and container of claim 1, wherein said at least one of said first and second female receptacles of a first said container is dimensioned to receive said at least one cylindrical male member of a second said container.

4. The combination toy building block and container of claim 1, wherein said at least one spout receptacle of a first said container is dimensioned to receive said at least one spout portion of a second said container.

5. The combination toy building block and container of claim 1, wherein said at least one spout receptacle of a first said container is dimensioned to receive said at least one cylindrical male member of a second said container.

6. The combination toy building block and container of claim 1, wherein said at least one spout portion is adapted to receive a cap.

7. The combination toy building block and container of claim 6, wherein said at least one spout portion of a first said container is adapted to be selectably engaged with and received by at least said first female receptacle, said second female receptacle and said at least one spout receptacle of a second said container when said at least one spout portion is either capped or uncapped by said cap.

8. The combination toy building block and container of claim 1, wherein said at least one spout portion is carried by said outer wall, and wherein said at least one spout receptacle is defined opposite thereof on said outer wall.

9. The combination toy building block and container of claim 1, wherein said at least one receptacle of said first said container is dimensioned to receive said at least one spout portion of a second said container.

10. A method of using a container as a toy building block, comprising the steps of:

a. obtaining two or more of a combination toy building block and container, said combination toy building block and container comprising at least one male connector disposed on a first wall thereof, at least one female connector formed on a second wall thereof, at least one spout portion disposed on a third wall thereof, and at least one spout receptacle disposed on a fourth wall thereof, wherein said at least one female connector of a first said container is dimensioned to receive said at least one spout portion of a second said container;

b. engaging either said at least one male connector or said at least one spout portion of a first said combination toy building block and container with either said at least one female connector or said at least one spout receptacle of a second said combination toy building block and container; and c. continuing to combine a plurality of said combination toy building blocks and containers to one another in a similar manner to form a desired configuration.

11. A combination toy building block and container for holding liquids and the like, comprising:

a container having at least one outer wall defining an interior cavity;

at least one male member disposed on said container;

at least one female receptacle defined on said container;

at least one handle dimensioned to be received within said at least one female receptacle; and, at least one spout, said at least one spout disposed within a recess formed at a corner or edge of said outer wall.

12. The combination toy building block and container of claim 11, wherein said at least one male member is carried by said outer wall, and wherein said at least one female receptacle is defined opposite thereof on said outer wall.

13. The combination toy building block and container of claim 11, wherein said at least one spout is disposed approximately perpendicular to said at least one male member.

14. The combination toy building block and container of claim 11, wherein said at least one female receptacle of a first said container is dimensioned to receive said at least one male member of a second said container.

15. A combination toy building block and container for holding liquids and the like, comprising:

a container having at least one outer wall defining an interior cavity;

at least one male member disposed on said container;

at least one female receptacle defined on said container, wherein said at least one female receptacle of a first said container is dimensioned to receive said at least one male member of a second said container;

at least one handle disposed proximate to said at least one male member; and, at least one spout, said at least one spout disposed within a recess formed at a corner or edge of said outer wall.

16. The combination toy building block and container of claim 15, wherein said at least one male member is carried by said outer wall, and wherein said at least one female receptacle is defined opposite thereof on said outer wall.

17. The combination toy building block and container of claim 15, wherein said at least one female receptacle of a first said container is dimensioned to receive said at least one male member of a second said container.

18. The combination toy building block and container of claim 15, wherein said at least one spout is adapted to receive a cap.

19. The combination toy building block and container of claim 15, wherein said at least one female receptacle of a first said container is dimensioned to receive said at least one handle of a second said container.

20. A method of using a container as a toy building block, comprising the steps of:

a. obtaining two or more of a combination toy building block and container, said combination toy building block and container comprising at least one male connector and at least one handle disposed on a first wall of said combination toy building block and container, and at least one female connector formed on a second wall of said combination toy building block and container;

b. engaging a first said combination toy building block and container with a second said combination toy building block and container according to a desired method of configuration, said desired method of configuration selected from the group consisting of, engaging said at least one male connector of said first combination toy building block and container with said at least one female connector of said second combination toy building block and container, engaging said at least one handle of said first combination toy building block and container with said at least one female connector of said second combination toy building block and container, and combinations thereof and, c. continuing to combine a plurality of said combination toy building blocks and containers to one another to form a desired configuration.

* * * * *